US010799888B2

(12) United States Patent
Kawabe et al.

(10) Patent No.: US 10,799,888 B2
(45) Date of Patent: Oct. 13, 2020

(54) DISCHARGE DEVICE

(71) Applicant: HONDA MOTOR CO., LTD., Minato-ku, Tokyo (JP)

(72) Inventors: Gaku Kawabe, Tochigi-ken (JP); Shinya Murakami, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 75 days.

(21) Appl. No.: 15/872,061

(22) Filed: Jan. 16, 2018

(65) Prior Publication Data

US 2018/0200735 A1 Jul. 19, 2018

(30) Foreign Application Priority Data

Jan. 18, 2017 (JP) ..... 2017-006844

(51) Int. Cl.
*B05B 13/04* (2006.01)
*B05B 1/14* (2006.01)

(52) U.S. Cl.
CPC ..... *B05B 1/14* (2013.01); *B05B 13/0431* (2013.01); *B05B 13/0452* (2013.01)

(58) Field of Classification Search
CPC ..... B05B 1/14; B05B 1/042; B05B 13/0431; B05B 13/0452
USPC ..... 239/601; 222/575
See application file for complete search history.

(56) References Cited

U.S. PATENT DOCUMENTS 660,948 A * 10/1900 Carlisle ..... B05B 1/18 239/437
1,507,784 A * 9/1924 Malin ..... F04F 5/46 239/601
8,303,082 B2 11/2012 Menzel et al.
2012/0178039 A1* 7/2012 Kagaya ..... B23K 1/0016 165/177
2017/0225179 A1 8/2017 Kawabe et al.

FOREIGN PATENT DOCUMENTS

JP 64-067280 3/1989
JP 10-024259 1/1998
JP 2010-240639 10/2010
JP 2017-140565 8/2017

OTHER PUBLICATIONS

Japanese Office Action for Japanese Patent Application No. 2017-00684 dated Nov. 13, 2018.

* cited by examiner

*Primary Examiner* — Tuongminh H Pham
(74) *Attorney, Agent, or Firm* — Amin, Turocy & Watson, LLP

(57) ABSTRACT

A discharge device is equipped with a housing having a flow passage for enabling a coating material to flow and a plurality of discharge ports arrayed on a distal end surface of the housing in a width direction for discharging the coating material toward an object. The plurality of discharge ports are each formed in a non-perfect circular shape having a peripheral length being longer than an imaginary perfect circular shape which has the same area as the non-perfect circular shape. Further, a plurality of discharge flow passages are perpendicular to the discharge ports when viewed in a longitudinal sectional view, are the same shape as the discharge ports, and extend linearly.

4 Claims, 7 Drawing Sheets

DISCHARGE DEVICE

CROSS-REFERENCE TO RELATED APPLICATION

This application is based upon and claims the benefit of priority from Japanese Patent Application No. 2017-006844 filed on Jan. 18, 2017, the contents of which are incorporated herein by reference.

BACKGROUND OF THE INVENTION

Field of the Invention

The present invention relates to a discharge device for discharging a coating material to an object.

Description of the Related Art

As disclosed in Japanese Laid-Open Patent Publication No. 10-024259 for example, a discharge device is provided as an end effector of a painting robot and discharges a coating material while being moved relative to an object such as a vehicle body or the like. Further, in the discharge device disclosed in the aforementioned Japanese Laid-Open Patent Publication No. 10-024259, a plurality of coating nozzles are arranged linearly at predetermined intervals, and each nozzle is switched between use and non-use, so that the coating material is discharged to a desired coating area.

SUMMARY OF THE INVENTION

However, in such a discharge device, where any disturbance element such as a burr, a manufacturing error, abrasion, a lump of the coating material or the like exists around a discharge port for discharging the coating material, the coating material is discharged toward an inclined direction by the influence of the disturbance element. Therefore, a possibility arises that the coating quality is degraded. For example, where a substantial distance exists between the discharge port of the discharge device and the object, an anxiety arises that a gap is made between areas coated by coating materials discharged from adjoining discharge ports. In particular, where a viscous material being high in viscosity is used as the coating material, the influence of the disturbance element becomes remarkable.

The present invention has been made to solve the aforementioned problem, and it is an object of the present invention to provide a discharge device capable of discharging a coating material accurately and thus of enhancing the coating quality greatly by suppressing the influence of any disturbance element by a simple construction.

In order to accomplish the aforementioned object, a discharge device according to the present invention features comprising a housing having a flow passage for enabling a coating material to flow, and a discharge port provided on a discharge surface of the housing and communicating with the flow passage for discharging the coating material toward an object, wherein the discharge port is formed in a non-perfect circular shape having a longer peripheral length than an imaginary perfect circular shape which has the same area as the discharge port, and wherein the flow passage is perpendicular to the discharge port when viewed in a longitudinal sectional view, is the same shape as the discharge port, and extends linearly.

With this construction, because of a simple structure of being formed in the non-perfect circular shape having the longer peripheral length than the imaginary perfect circular shape having the same area, the discharge port and the flow passage of the discharge device can suppress the influence of an disturbance element exerted on the coating material when the coating material flows through the flow passage or when the coating material is discharged from the discharge port. That is, the coating material flowing through the flow passage becomes slow in velocity in the vicinity of the inner periphery of the flow passage but becomes fast in velocity in the vicinity of a center point of the flow passage, whereby a difference is produced in kinetic energy during the flow. Therefore, even if the disturbance element exists at the discharge port or in the flow passage, the influence of the disturbance element is hardly exerted on the straightness of the coating material in the vicinity of the center point where the kinetic energy is high, so that the coating material can be discharged excellently from the discharge port toward the discharge direction which is along a straight line of the flow passage. In particular, this advantageous effect becomes great where the viscosity of the coating material is high. Accordingly, the discharge device can discharge the coating material accurately and can enhance the coating quality greatly.

Further, preferably, the discharge port may take a cross shape having a central region of a square shape and four arm regions connected to four sides of the central region.

With this configuration, because the discharge port is formed in the cross shape, the peripheral length of the discharge port and the flow passage becomes sufficiently long in comparison with the peripheral length of the imaginary perfect circular shape. Therefore, it is possible to further increase the difference in the kinetic energy during the flow of the coating material, and hence, it is possible for the discharge port to discharge the coating material accurately and straighter.

Preferably, in addition to the aforementioned constructions, at the arm regions, the length in a first direction protruding outside from the central region may be shorter than the length in a second direction perpendicular to the first direction.

That is, with this configuration, because the arm regions protruding from the central region are formed in a flat shape, the discharge port and the flow passage can have a sufficiently large flow passage cross-sectional area at a central region and hence, enable the coating material of a sufficient quantity to flow stably.

Further preferably, the discharge port may be formed as a line symmetry or a point symmetry with respect to the center point.

With this configuration, because of being formed as the line symmetry or the point symmetry with respect to the center point, the discharge port can reliably put a portion having a high kinetic energy of the coating material at a central part of the discharge port and the flow passage during the flow. Therefore, it is possible to further stabilize the discharge direction of the coating material.

Here, the peripheral length of the discharge port is preferable to be 1.1 (one point one) times or more as long as the peripheral length of the imaginary perfect circular shape.

Like this, with this construction, when the peripheral length of the discharge port is 1.1 times or more as long as the peripheral length of the imaginary perfect circular shape, the discharge device can discharge the coating material from the discharge port sufficiently straight.

Still further preferably, the length of the flow passage may be 10 (ten) times or more as along as the diameter of the imaginary perfect circular shape.

With this construction, because of flowing through the flow passage of the length having the ten times or more as long as the diameter of the imaginary perfect circular shape, the coating material has excellent straightness in the flow passage, and hence, it is possible to discharge the coating material more stably from the discharge port.

Yet further preferably, a plurality of discharge ports each taking the construction as described above may be provided linearly and at regular intervals on the discharge surface in the width direction.

With this construction, it is possible for the discharge device to discharge coating materials straight from the plurality of discharge ports arrayed straight and at regular intervals. Thus, it is possible to form a coating film of a high quality easily.

According to the present invention, the discharge device can suppress the influence of the disturbance element by the simple structure and can discharge the coating material accurately, whereby the coating quality can be enhanced greatly.

The above and other objects features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Hereafter, a discharge device according to the present invention will be described based on a preferred embodiment with reference to the accompanying drawings.

Figure 1:
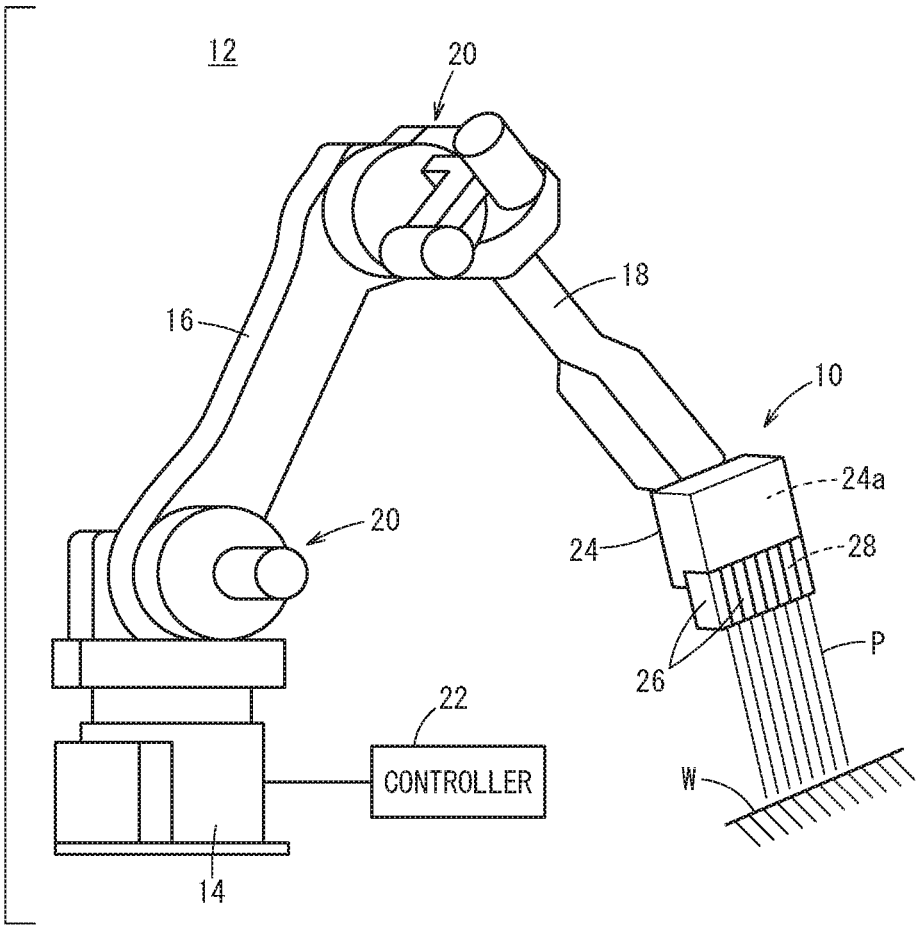
FIG. 1 is an explanatory view schematically showing a painting robot to which a discharge device according to one embodiment of the present invention is attached.

A discharge device 10 according to one embodiment of the present invention is applicable to, for example, an end effector for a painting robot 12 (painting apparatus) installed at a factory or the like as shown in FIG. 1. The discharge device 10 discharges a coating material P to an object W such as an interior of a vehicle, a vehicle body or the like to form a coating film on the object W. Although no limitation is given to the coating material P discharged by the discharge device 10, the following description will be made taking as an example a discharge device 10 which discharges a viscous material being high in viscosity such as a damping material, a vibration-proof material or the like.

The painting robot 12 is configured as an articulated robot and has a base portion 14, a first arm portion 16 and a second arm portion 18. Interconnections are made through joints 20 between the base portion 14 and the first arm portion 16 and between the first arm portion 16 and the second arm portion 18. The joints 20 couple the respective portions (for example, the base portion 14 and the first arm portion 16) to be relatively rotatable about two axes perpendicular to each other.

The discharge device 10 is secured to the distal end (end portion opposite to an end portion coupled to the first arm portion 16) of the second arm portion 18. The painting robot 12 operates the first and second arm portions 16, 18 under the control of a controller 22 and moves the discharge device 10 to face the object W. Incidentally, the discharge device 10 may be attached to the second arm portion 18 through a joint not shown which is capable of varying the posture or orientation of the discharge device 10.

Further, the discharge device 10 is connected to a tube (not shown) extending inside or outside of the second arm portion 18. The other end of the tube is connected to a coating material supply source (not shown) provided on or outside the painting robot 12. The coating material supply source supplies the tube with the coating material P under the driving control of a booster provided therein.

The discharge device 10 discharges the coating material P by a predetermined discharge quantity at a predetermined discharge velocity based on a supply pressure of the coating material P supplied from the tube. Incidentally, the discharge device 10 may be equipped with an air ejection mechanism or the like (not shown) being controllable by the controller 22 and discharge (or spray) the coating material P together with the ejection of air.

Specifically, the discharge device 10 is equipped with a support body 24 attached to the second arm portion 18 and a plurality of coating nozzles 26 fixedly supported on the support body 24 for discharging the coating material P to the object W. The plurality of coating nozzles 26 are juxtaposed along a width direction of the support body 24. Therefore, the discharge device 10 is able to perform a painting operation by discharging the coating material P over a predetermined area in the width direction in which the coating nozzles 26 are arrayed.

The support body 24 of the discharge device 10 is configured as a block being wide in a width direction perpendicular to the axial direction of the second arm portion 18. The plurality of coating nozzles 26 is coupled to the distal end side of the support body 24. The aforementioned tube is inserted into and connected to the proximal end side of the support body 24. Inside this support body 24, a flow divider circuit 24*a* (refer also to FIG. 2) is provided that distributes the coating material P supplied from the tube to the respective coating nozzles 26. The flow divider circuit 24*a* ramifies within the support body 24 in correspondence to the number of the coating nozzles 26 arrayed in the width direction, and branched flow passages thus made extend to connection portions between the support body 24 and the respective coating nozzles 26. Further, the flow divider circuit 24*a* is capable of distributing the coating materials P at a uniform supply pressure to the respective branched flow passages.

Figure 2:
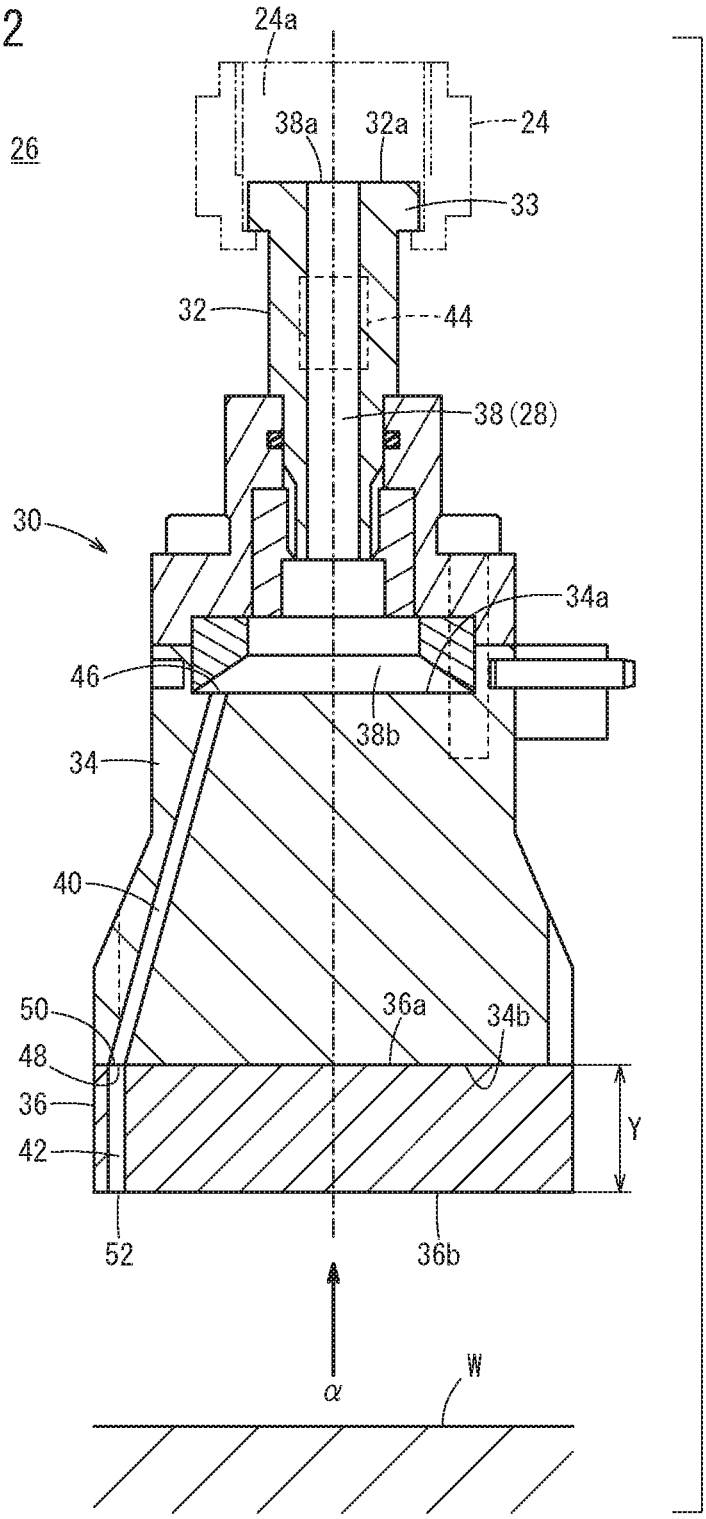
FIG. 2 is a longitudinal sectional view of a coating nozzle of the discharge device shown in FIG. 1.

The plurality of coating nozzles 26 enable the coating materials P that have come from the support body 24 thereto, to flow through the flow passages 28 inside the coating nozzles 26, and discharge the coating materials P from the distal end thereof. As shown in FIG. 2, the coating nozzle 26 is formed in a single housing 30 which is configured by having a plurality of members assembled. The plurality of members include a connector member 32, a nozzle body 34, an attachment 36 and the like.

The connector member 32 is a member connected directly to the support body 24 and is provided at the proximal end portion thereof with an engagement portion 33 fixedly inserted into the support body 24. The nozzle body 34 is fixedly connected to the distal end side of the connector member 32 through several members and has a function of further distributing the coating material P supplied to the coating nozzle 26. The attachment 36 is fixedly attached to the distal end of the nozzle body 34 for stably discharging the distributed coating material P. By these members, the flow passage 28 within the housing 30 is configured to have a common flow passage 38, a plurality of branch flow passages 40 and a plurality of discharge flow passages 42.

The common flow passage 38 is provided on the proximal end side of the housing 30 including the connector member 32. Specifically, the proximal end side of the common flow passage 38 extends axially inside the connector member 32 and communicates with a proximal end opening 38*a* formed on a proximal end surface 32*a*. This proximal end opening 38*a* communicates with a branch flow passage of the flow divider circuit 24*a* and constitutes an inflow portion that lets the coating material P flow into the coating nozzle 26.

The common flow passage 38 is provided with a valve mechanism 44, and this valve mechanism 44 performs the opening/closing of the flow passages 28 under the control of the controller 22. That is, with respect to the plurality of coating nozzles 26 arrayed linearly in the width direction, the discharge device 10 is able to set the coating nozzles 26 to discharge the coating material P by selecting the opening or closing of the flow passages 28. Thus, a coating area of the coating material P can be adjusted freely.

Further, the distal end side (the vicinity of the nozzle body 34) of the common flow passage 38 is provided with a chamber portion 38*b* whose flow passage cross-section shape is wide in a radial direction. The chamber portion 38*b* makes the incoming coating material P stay temporarily. A proximal end surface 34*a* of the nozzle body 34 constitutes one side surface (surface facing the common flow passage 38) of the chamber portion 38*b*. Proximal end openings 46 provided on the proximal end surface 34*a* of the nozzle body 34 communicate with the chamber portion 38*b*.

Figure 3B:
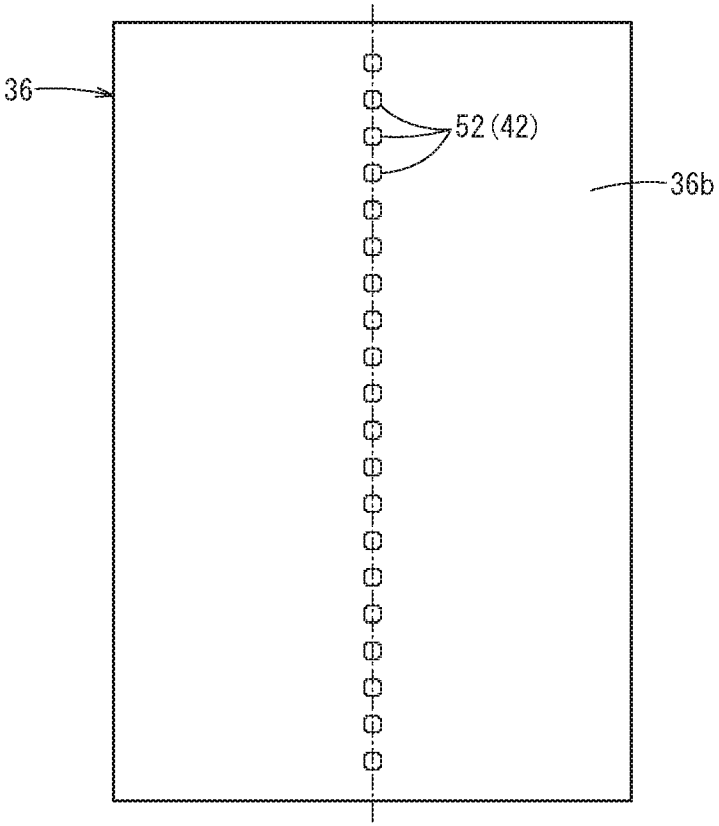
FIG. 3B is a front view as viewed from the distal end side of an attachment shown in FIG. 2.
Figure 3A:
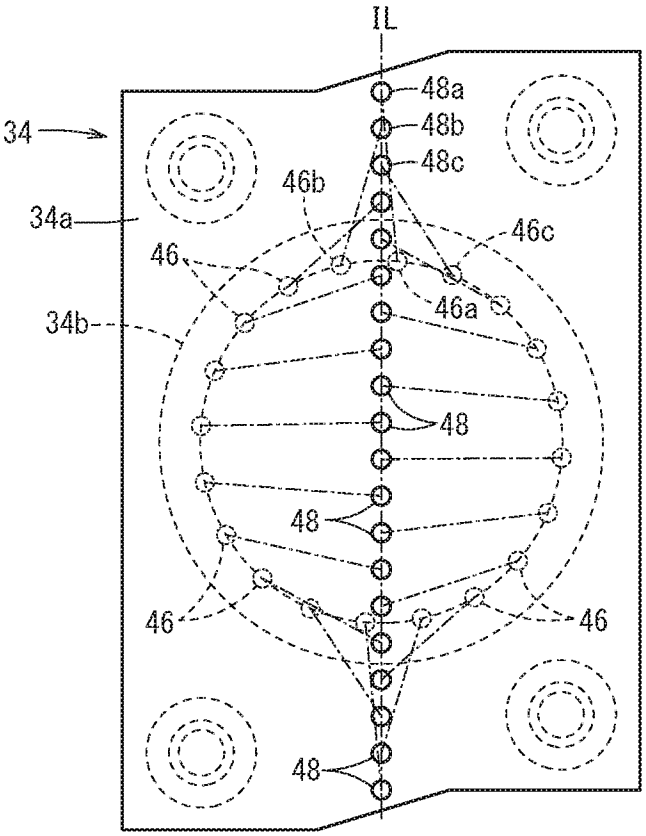
FIG. 3A is a front view as viewed from the distal end side of a nozzle body shown in FIG. 2.

The plurality of branch flow passages 40 are each formed to be thinner than the common flow passage 38 and respectively have the proximal end openings 46 on the proximal end side. Each branch flow passage 40 pierces the proximal end surface 34*a* and the distal end surface 34*b* of the nozzle body 34. Then, as shown in FIG. 3A, the proximal end openings 46 of the respective branch flow passages 40 are arranged annularly on the proximal end surface 34*a* of the nozzle body 34 while distal end openings 48 of the respective branch flow passages 40 are arranged linearly on the distal end surface 34*b* of the nozzle body 34. Each branch flow passage 40 extends linearly between the proximal end opening 46 and the distal end opening 48 (refer also to FIG. 2).

Here, the arrangement relationship between the proximal end openings 46 and the distal end openings 48 of the nozzle body 34 will be described in detail with reference to FIG. 3A. When the nozzle body 34 is viewed from the distal end side, an imaginary array straight line IL can be drawn by connecting the centers of the respective distal end openings 48 arrayed in a line. In this arrangement, a proximal end opening 46*a* closest to the imaginary array straight line IL among the respective proximal end openings 46 arrayed annularly on the proximal end surface 34*a* communicates with the farthest distal end opening 48*a* (one at one end side in the width direction of the nozzle body 34) of the respective distal end openings 48. Then, a proximal end opening 46*b* which is adjacent to the proximal end opening 46*a* closest to the imaginary array straight line IL and which is located on an opposite side of the imaginary array straight line IL communicates with the second farthest distal end opening 48*b*. Further, a proximal end opening 46*c* which is adjacent to the proximal end opening 46*a* closet to the imaginary array straight line IL and which is located on the opposite side of the imaginary array straight line IL communicates with the third farthest distal end opening 48*c*. Similarly, the plurality of branch flow passages 40 have an arrangement relationship that the respective proximal end openings 46 on one side and the other side of the imaginary array straight line IL communicate alternately with respective distal end openings 48 arrayed linearly. In this way, the plurality of branch flow passages 40 are able to extend linearly without interfering mutually.

On the other hand, as shown in FIG. 2, the plurality of discharge flow passage 42 are provided in the attachment 36 to communicate with the branch flow passages 40 of the nozzle body 34 and let the coating materials P flowing obliquely through the branch flow passages 40 be discharged at the right angle with respect to the object W. To this end, the respective discharge flow passages 42 extend linearly along the thickness direction of the attachment 36 (i.e., axially of the coating nozzle 26) as viewed in a longitudinal sectional view and pierce the proximal end surface 36*a* to the distal end surface 36*b* (discharge surface) of the attachment 36. Further, the respective discharge flow passages 42 are provided to be arrayed in a straight line at regular intervals along the width direction (the imaginary array straight line IL) of the attachment 36 (refer also to FIG. 3B). Incidentally, the nozzle body 34 and the attachment 36 may be formed integrally.

The proximal end surface 36*a* of the attachment 36 is formed with proximal end openings 50 respectively communicating with the plurality of discharge flow passages 42, and the respective proximal end openings 50 respectively face the distal end openings 48 of the branch flow passages 40. Further, the distal end surface 36*b* of the attachment 36 is formed with discharge ports 52 respectively communicating with the respective discharge flow passages 42. The coating materials P flowing through the discharge flow passages 42 are discharged from the plurality of discharge ports 52 toward the object W.

Figure 4:
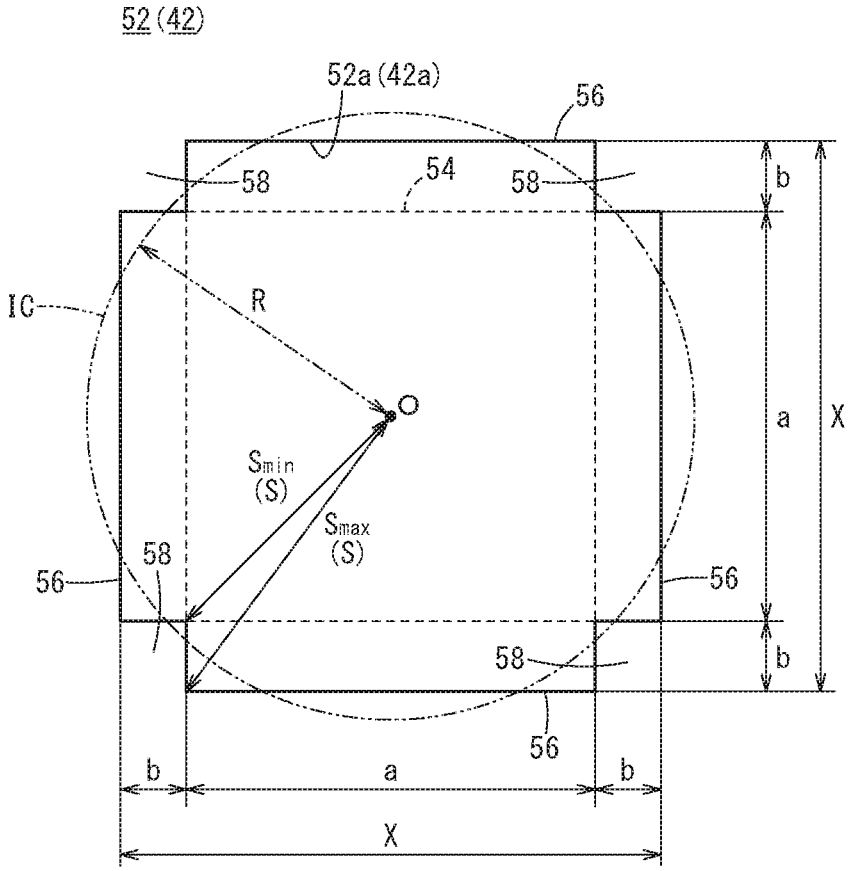
FIG. 4 is an explanatory view showing a discharge port of the discharge device in an enlarged scale.

As shown in FIG. 4, each discharge port 52 is cross-shaped in a front view (as viewed from the arrow a direction in FIG. 2) when the attachment 36 is viewed from the distal end side. That is, the discharge port 52 takes a non-perfect circular shape. Further, each discharge flow passage 42 also takes the same shape (the same cross-sectional area) as each discharge port 52 and extends linearly inside the attachment 36. The proximal end opening 50 of each discharge flow passage 42 also takes the same shape as the discharge port 52.

More specifically, each discharge port 52 of the attachment 36 has a square-shaped central region 54 where the length of one side is a, and four rectangular arm regions 56 respectively connected to four sides of the central region 54. In this case, the length of one side in the longitudinal direction (the second direction) of each arm region 56 is the same length a as the length of one side of the central region 54. On the other hand, the length b in a short-side direction (the first direction) of each arm region 56 is sufficiently shorter than the length a in the longitudinal direction.

For example, the relationship between the length a in the longitudinal direction and the length b in the short-side direction is preferable set to a range of b/a=1/3 to 1/10 and is more preferable set to a range of b/a=1/5 to 1/8. Where the ratio b/a is larger than 1/3, the cross-sectional area of the central region 54 becomes too small, and hence, a possibility arises that the discharge quantity of the coating material P becomes too small. When the ratio b/a is smaller than 1/10, the peripheral length is not long enough compared to the peripheral length of a perfect circular shape having the same area, and hence, a possibility arises that advantageous effects referred to later become difficult to acquire.

In the above described discharge port 52, the length X in one direction of the cross shape portion becomes one (X=a+2b) which is obtained by the addition of the length a on one side of the central region 54 and the lengths 2b in the short side direction of the two arm regions 56. Further, the length in the other direction perpendicular to the one direction also becomes the same length. In other words, it can be said that the cross-shaped discharge port 52 is a shape in which a square-shaped protrusion 58 having each side of the length b is provided at four corners of a square shape having each side of the length X. For example, the actual dimension of the length X of the discharge port 52 is approximately 0.3 mm to 2.0 mm. The discharge flow passage 42 of this size can be formed by wire electric discharge machining or the like.

The above described discharge port 52 has an inner periphery 52*a* of the discharge port 52 that is constituted by the four arm regions 56, and this inner periphery 52*a* is formed to be a line symmetry and a point symmetry with respect to a center point O (an intersection point of the diagonals) of the central region 54. Incidentally, the shape of the inner periphery 52*a* may be a shape that has either one of the line symmetry and the point symmetry.

When an imaginary perfect circular shape IC (refer to the two-dot chain line in FIG. 4) is drawn having the same area as the discharge port 52, the inner periphery 52*a* of the discharge port 52 has a longer peripheral length than the imaginary perfect circular shape IC does, and the inner surface (inner periphery 42*a*) of the discharge flow passage 42 also extends linearly with the same peripheral length. For this reason, the coating material P which flows in the vicinity of the inner periphery 42*a* of the discharge flow passage 42 is more likely to receive resistance from the inner wall, whereby a large difference in velocity (kinetic energy) arises between the coating material P flowing in the vicinity of the center point O and the coating material P flowing in the vicinity of the inner periphery 42*a*. Accordingly, the coating material P is discharged while being largely influenced by kinetic energy in the vicinity of the center point O at the timing of being discharged from the discharge port 52.

Referring back to FIG. 2, the length of the discharge flow passage 42 (distance between the discharge port 52 and the proximal end opening 50, namely the thickness of the attachment 36) is set to a length that stabilizes the discharge direction of the coating material P. More specifically, the length of the discharge flow passage 42 is preferable to be 10 (ten) times or more as long as a diameter R of the imaginary perfect circular shape IC having the same area as the discharge port 52. The actual dimension of the length of the discharge flow passage 42 suffices to be, for example, 5 mm or longer and is set to be 10 mm in the present embodiment.

Furthermore, the proximal end opening 50 of the discharge port 42 is designed to have a dimension in which the distal end opening 48 of the nozzle body 34 formed in a perfect circular shape can be accommodated. Thus, the coating material P flows smoothly from the branch flow passage 40 to the discharge flow passage 42. Further, the discharge flow passage 42 may be constructed such that the proximal end opening 50 is formed in the same shape as the distal end opening 48 of the branch flow passage 40 and is gradually transformed into the shape of the discharge port 52 along the discharge flow passage 42.

The discharge device 10 according to the present embodiment is basically constructed as described above, and the operational advantageous effects will hereafter be described.

As shown in FIG. 1, the painting robot 12 with the discharge device 10 mounted thereon operates the first and second arm portions 16, 18 under the control of the controller 22 to place the discharge device 10 at a suitable position (a position facing the object W). Subsequently, the controller 22 drives the booster of the coating material supply source to supply the discharge device 10 with the coating material P through the tube. Thus, the discharge device 10 discharges the coating material P supplied thereto to the object W. The painting robot 12 forms a coating film of a desired thickness on the object W by moving the discharge device 10 while discharging the coating material P from the discharge device 10.

More specifically, when supplied with the coating material P from the tube, the discharge device 10 distributes the coating material P to the plurality of coating nozzles 26 by making the coating material P pass through the flow divider circuit 24*a* inside the support body 24. When the flow passage 28 is closed by the valve mechanism 44 of the coating nozzle 26, the inflow of the coating material P to the coating nozzle 26 is stopped. When the flow passage 28 is held opened by the valve mechanism 44, the coating material P flows to the coating nozzle 26.

As shown in FIG. 2, the coating material P having flown to the coating nozzle 26 first flows through the common flow passage 38 and then flows into the chamber portion 38*b*. Then, the coating material P moves to the plurality of branch flow passages 40 from the proximal end openings 46 of the nozzle body 34 opening to the chamber portion 38*b*. In short, by the branch flow passages 40, the coating material P is branched to be discharged from the individual discharge ports 52. The branched coating materials P flow along the slopes of the branch flow passages 40 and move from the distal end openings 48 of the branch flow passages 40 to the proximal end openings 50 of the discharge flow passages 42.

Figure 5A:
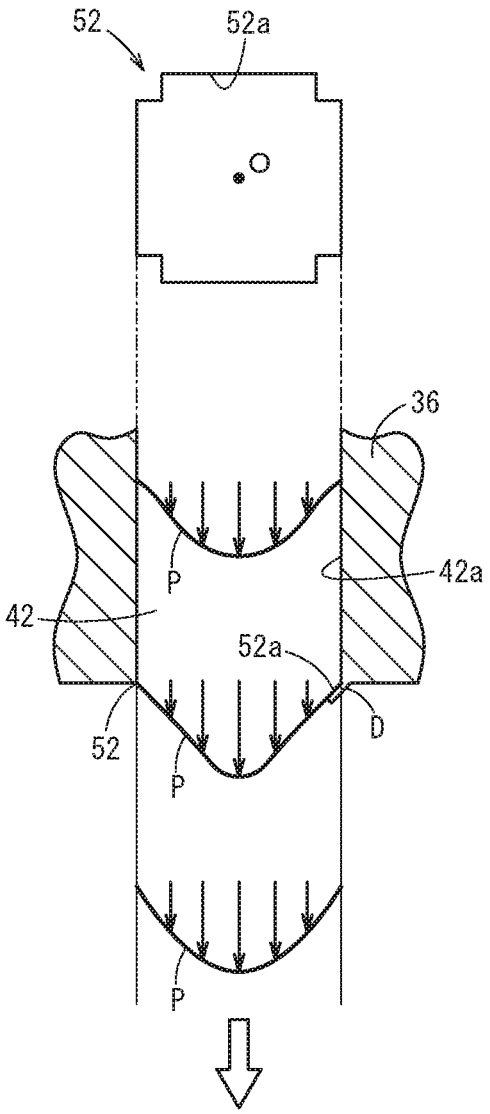
FIG. 5A is an explanatory view showing the flow state of a coating material from the discharge port shown in FIG. 4.

Then, as shown in FIG. 2 and FIG. 5A, the coating material P having flown to each discharge flow passage 42 flows linearly in the thickness direction of the attachment 36. Here, the discharge flow passage 42 according to the present embodiment is cross-shaped as viewed in the cross-section perpendicular to the axial direction of the discharge flow passage 42, and the peripheral length of the inner periphery 42*a* is made to be longer than the peripheral length of the imaginary perfect circular shape IC (refer to FIG. 5B) having the same area.

Figure 5B:
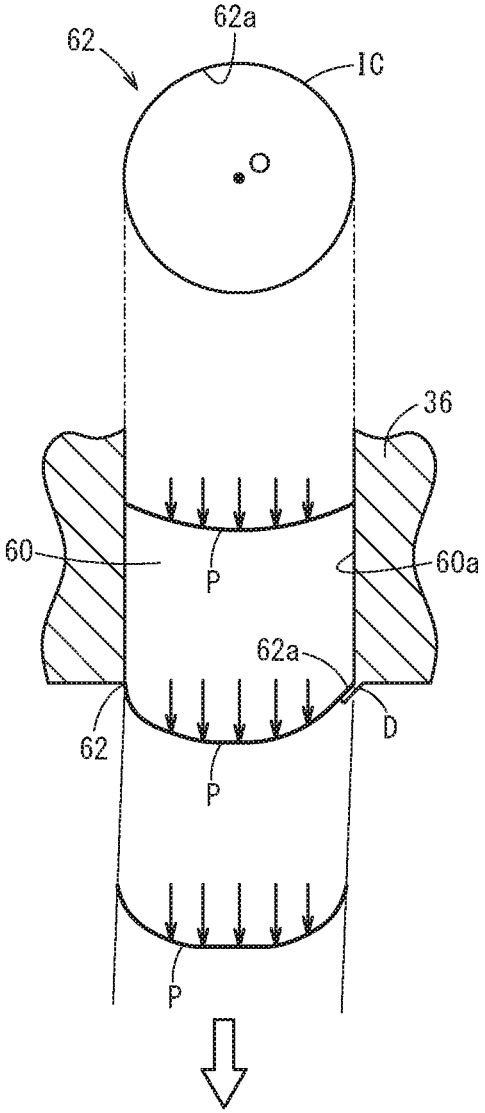
FIG. 5B is an explanatory view showing the flow state of the coating material from a discharge port taking an imaginary perfect circular shape which is the same in area as the discharge port shown in FIG. 4.
Figure 6B:
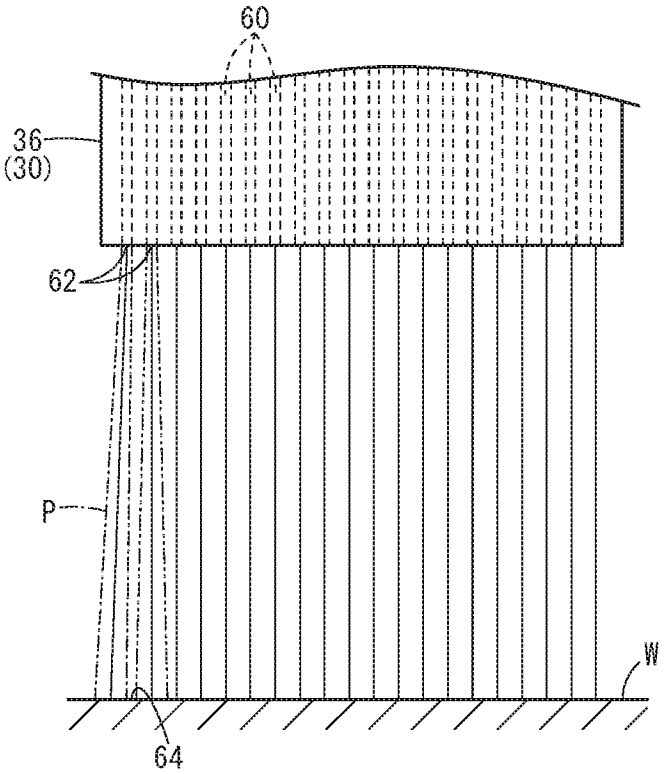
FIG. 6B is an explanatory view exemplifying a state in which the discharge port shown in FIG. 5B applies the coating material to the object.

FIG. 5B shows a comparative example, wherein an inner periphery 60*a* of a discharge flow passage 60 (discharge port 62) having the imaginary perfect circular shape IC has a shorter peripheral length. Therefore, in this comparative example, the coating material P, when flowing through the discharge flow passage 60, does not produce a large difference in kinetic energy between the vicinity of the inner periphery 60*a* and the vicinity of the center point O. Therefore, where the discharge flow passage 60 (discharge port 62) has a disturbance element D (a burr, a manufacturing error, a lump of coating material P or the like), the influence given to the kinetic energy of the whole of the coating material P becomes large, whereby the coating material P is discharged from the discharge port 62 in an inclined discharge direction. Accordingly, as shown in FIG. 6B, the discharge flow passage 60 having the imaginary perfect circular shape IC does not discharge the coating material P straight from the discharge port 62 having the disturbance element D, and thus, a possibility arises that a coating film is formed with a gap 64 where the coating material P is not coated. In other words, the discharge port 62 having the imaginary perfect circular shape IC is liable to incline the discharge direction of the coating material P, whereby the quality of the coating film is liable to be degraded.

On the contrary, as shown in FIG. 5A, according to the discharge flow passage 42 (discharge port 52) of the cross shape according to the present embodiment, the velocity of the coating material P becomes slow in the vicinity of the inner periphery 42*a* but becomes fast in the vicinity of the center point O. That is, in the discharge flow passage 42, the kinetic energy of the coating material P, when flowing, shows a large difference (a distribution of the kinetic energy being large in the vicinity of the center point O and being small in the vicinity of the inner periphery 42*a*). The difference in the kinetic energy becomes the largest at the discharge port 52 after the coating material P has flown through the discharge flow passage 42. Accordingly, even if the disturbance element D exists at, for example, the discharge port 52, the influence that the disturbance element D exerts on the kinetic energy of the whole of the coating material P becomes sufficiently small. As a result, the coating material P is discharged stably from the discharge port 52 toward a discharge direction which coincides with the extending direction of the discharge flow passage 42.

Figure 6A:
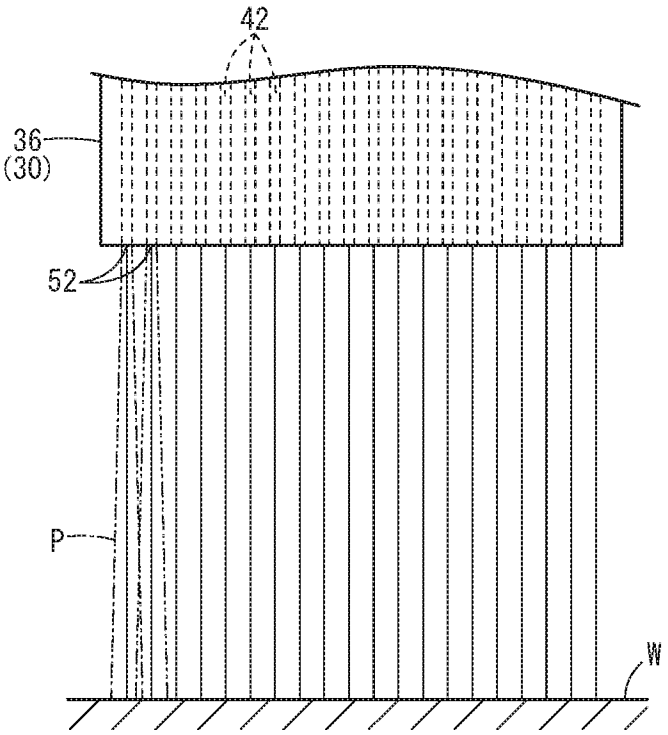
FIG. 6A is an explanatory view exemplifying a state in which the discharge port shown in FIG. 5A applies the coating material to an object.
Figure 7A:
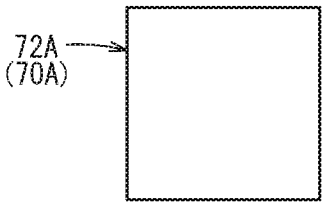
FIG. 7A to FIG. 7F are explanatory views showing discharge ports according to modifications.
Figure 7B:
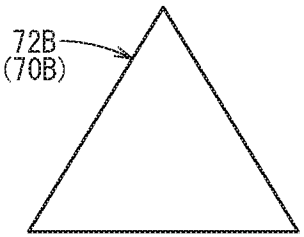
Figure 7C:
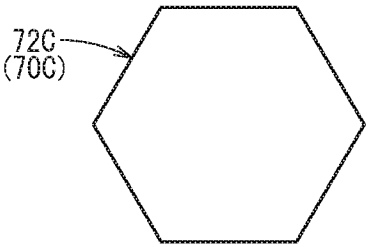
Figure 7D:
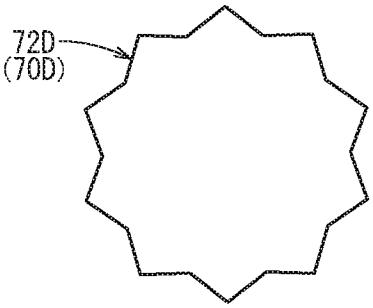
Figure 7E:
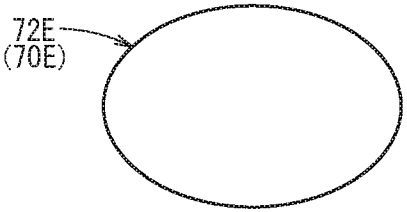
Figure 7F:
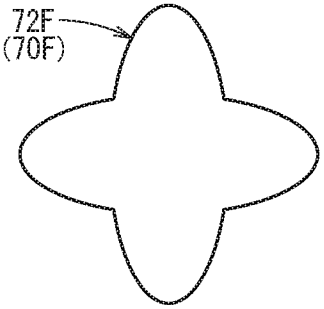

Accordingly, as shown in FIG. 6A, where the object W exists under the discharge device 10, the discharge direction of the coating material P becomes perpendicular to the port surface of the discharge port 52 to extend straight from the discharge port 52. Then, the coating material P, when hitting on the object W, spreads over a surface to be coated of the object W and is superimposed on the coating material P discharged from an adjacent discharge port 52, whereby a gapless coating film can be formed.

As described above, the discharge device 10 according to the present embodiment can suppress the influence of the disturbance element D by a simple structure that the discharge flow passage 42 and the discharge port 52 are each formed in the non-perfect circular shape having the longer peripheral length than the peripheral length of the imaginary perfect circular shape IC having the same area. That is, the coating material P flowing through the discharge flow passage 42 becomes slow in velocity in the vicinity of the inner periphery 42*a* of the discharge flow passage 42 but becomes fast in velocity in the vicinity of the center point O of the discharge flow passage 42 and thus, a difference is produced in the kinetic energy during the flow. Thus, even if the disturbance element D exists at the discharge flow passage 42 or the discharge port 52, the influence is hardly exerted on the straightness of the coating material P flowing in the vicinity of the center part where the kinetic energy is high, and hence, the coating material P is discharged satisfactorily from the discharge port 52 toward the discharge direction which is along the straight line of the discharge flow passage 42. Accordingly, it is possible for the discharge device 10 to discharge the coating material P accurately and hence, to increase the coating quality greatly.

Further, because of being formed in the cross shape, the discharge flow passage 42 and the discharge port 52 become sufficiently long in peripheral length in comparison with the imaginary perfect circular shape IC. Therefore, the difference in the kinetic energy during the flow of the coating material P can be made larger, and thus, it is possible for the discharge port 52 to discharge the coating material P further accurately linearly.

Furthermore, because of having the arm regions 56 each protruding from the central region 54 and each formed in a flat shape, the discharge port 52 can be made to have a sufficiently large cross-sectional area of the flow passage of the central region 54. Therefore, it is possible to make the coating material P of a sufficient quantity to flow stably. Still furthermore, because of being formed in a point symmetry (line symmetry) with respect to the center point O, the discharge port 52 is able to reliably put a high kinetic energy portion of the coating material P during the flow, at a central part of the discharge flow passage 42 and the discharge port 52. Therefore, it is possible to make the discharge direction of the coating material P more stable. Incidentally, the discharge device 10 is able to discharge the coating material P from the discharge port 52 sufficiently linearly when the peripheral length of the inner periphery 52*a* of the discharge port 52 is 1.1 (one point one) times or more as long as the peripheral length of the imaginary perfect circular shape IC.

Then, because the length of the discharge flow passage 42 is set to be 10 (ten) times or more as long as the diameter R of the imaginary perfect circular shape IC, the coating material P has an excellent straightness and thus is discharged more stably. Yet furthermore, by discharging the coating materials P straight from the plurality of discharge ports 52 arrayed linearly and at regular intervals, the discharge device 10 can easily form a high quality coating film.

Obviously, the present invention is not limited to the foregoing embodiment, and various modifications are possible without departing from the gist of the present invention.

As an example, in place of the aforementioned discharge port 52 (discharge flow passage 42), the discharge device 10 may have any one of discharge ports 72A-72F (discharge flow passages 70A-70F) according to first through sixth modifications shown in FIG. 7A through FIG. 7F. In this case, any of these discharge ports 72A-72F also has a longer peripheral length than an imaginary perfect circular shape IC having the same area as the discharge ports 72A-72F.

In short, the shape of the discharge port 52 is properly designed based on the property (e.g., viscosity or the like) of a coating material P which is intended to be discharged from the discharge port 52. In the case of designing the discharge port 52, it is preferable to choose a shape (a shape with few corners) in which the space S (refer to FIG. 4) between the center point O and the inner periphery 52*a* (inner periphery 42*a*) does not vary largely and which has a long perimeter.

For example, it is possible to form the central region 54 wide if a ratio $S_{min}/S_{max}$ is in a range of 3/4 to 1 or so wherein the ratio can be calculated from a shortest space $S_{min}$ indicating that space S between the center point O and the inner periphery 52*a* is the shortest, and a largest space $S_{max}$ indicating that the space S is the largest. By designing like this, it is possible to secure the discharge quantity of the coating material P sufficiently.

Further, it is preferable that the inner periphery 52*a* (inner periphery 42*a*) of the discharge port 52 (discharge flow passage 42) be a shape having few acute bent portions. In this way, it can be suppressed that when the coating material P is made to flow through the discharge flow passage 42, the coating material P makes a lump at a bent portion to prevent the coating material P from flowing stably.

What is claimed is:

1. A coating apparatus for coating an object with a coating material, comprising:

a housing having a flow passage for enabling the coating material to flow and a discharge surface facing toward the object, the housing being disposed at a distal end of the coating apparatus at an outside of the coating appratus;

a discharge port provided on the discharge surface of the housing and communicating with the flow passage for discharging the coating material toward the object; and a proximal end opening provided on a proximal surface inside the coating apparatus, the proximal end opening having a same shape and same area as the discharge port, wherein the discharge port has a cross shape having a central region of a square shape and four arm regions connected to four sides of the central region;

the flow passage is perpendicular to the discharge port and the proximal end opening when viewed in a longitudinal sectional view, and extends straight between the discharge port and the proximal end opening in the same shape and same area as the discharge port;

the four arm regions respectively protrude perpendicularly from the four sides of the central region by a length with a width, the length being shorter than the width;

a length of the flow passage is ten times or more as long as a diameter of an imaginary circular shape having a same area as the discharge port; and a ratio of the length to the width of each of the four arm regions is set in a range of 1/3 to 1/10.

2. The coating apparatus according to claim 1, wherein the discharge port is formed to be a point symmetry where a point of symmetry of the shape of the discharge port is located on a center point of the discharge port.

3. The coating apparatus according to claim 1, wherein a peripheral length of the discharge port is one point one times or more as long as a peripheral length of an imaginary circular shape having a same area as the discharge port.

4. The coating apparatus according to claim 1, wherein a plurality of discharge ports are provided on the discharge surface linearly along a width direction and at regular intervals.

* * * * *